US005786664A

United States Patent [19]

Liu

[11] Patent Number: 5,786,664

[45] Date of Patent: Jul. 28, 1998

[54] DOUBLE-SIDED ELECTROLUMINESCENT DEVICE

[75] Inventor: Youmin Liu, 5568 W. 115th Dr., Westminster, Colo. 80020

[73] Assignee: Youmin Liu, Palo Alto, Calif.

[21] Appl. No.: 411,330

[22] Filed: Mar. 27, 1995

[51] Int. Cl.[6] ..... H01J 1/54; G09G 3/10

[52] U.S. Cl. ..... 313/506; 313/509; 313/512; 315/169.3; 428/917

[58] Field of Search ..... 313/506, 512, 313/509; 315/169.3; 428/917; 345/35, 45, 76

[56] References Cited

U.S. PATENT DOCUMENTS

| | | | |
|---|---|---|---|
| 3,497,750 | 2/1970 | Knockel et al. | 313/108 |
| 4,455,324 | 6/1984 | Kamijo et al. | 427/66 |
| 4,626,742 | 12/1986 | Mental | 313/503 |
| 4,758,765 | 7/1988 | Mitsumori | 313/506 |
| 4,835,190 | 5/1989 | Bezner et al. | 428/690 |
| 5,107,175 | 4/1992 | Hirano et al. | 313/512 |
| 5,235,246 | 8/1993 | Konishi | 313/506 X |
| 5,332,946 | 7/1994 | Eckersley et al. | 313/108 |
| 5,352,543 | 10/1994 | Ryu et al. | 428/690 |
| 5,405,709 | 4/1995 | Littman et al. | 313/506 X |
| 5,483,120 | 1/1996 | Murakami | 313/506 |
| 5,488,266 | 1/1996 | Aoki et al. | 313/506 X |

*Primary Examiner*—Ashok Patel

[57] ABSTRACT

A double-sided electroluminescent device emits light from its both sides and has a symmetrically laminated structure. The materials of the insulating layers and the binder of the phosphor layer are the same. The insulating layers and transparent insulating frame form a sealing box to encapsulate the phosphor layer. The bus bars are disposed oppositely in symmetry with respective to the symmetrical plane and a vertical axis of the device. The refractive index of the out most reinforcement layer is higher than that of the substrates.

17 Claims, 2 Drawing Sheets

DOUBLE-SIDED ELECTROLUMINESCENT DEVICE

The present invention relates a thin film electroluminescent device, more particularly to a double-sided electroluminescent device.

BACKGROUND OF THE INVENTION

Generally, a thin film electroluminescent (EL) device has a laminated structure of a number of thin layers. It includes a transparent reinforcement shell encapsulating the device and protecting the device from moisture and mechanical damage, a transparent substrate, a transparent front electrode, a phosphor layer, a transparent insulating layer, and a rear electrode. When an electrical field is applied to the two electrodes, the phosphor layer emits light from only one side of the device. When the light radiates through the laminated layers, the reflection occurs at each interface between two adjacent layers.

The mismatch of refractive index of the layers will reduce the luminescent intensity. In order to enhance the light intensity, a certain high permittivity powder, such as $TiO_2$ or $BaTiO_3$, is dispersed in the binder and insulating layer. For instance, U.S. Pat. No. 4,455,324 to Kamijo et al discloses the use of such powders. However, the dispersed powder may scatter the light. So far, no one, except the present inventor, has paid any attention to minimizing internal reflection at the interfaces of the multiple layer configuration and to light scattering problem in the EL device.

All of the prior electroluminescent devices emit light through only one side, such as those disclosed in U.S. Pat. Nos. 5,352,543; 5,332,946; 5,200,277; and 4,855,190. They are used as the back-lighting of an airplane and automobile dashboard, or for neon-like decoration. The one-sided light-emitting lamp has limits in application. It cannot use the light efficiently because the light emitted from the phosphor layer to the other side is wasted.

It is quite common to encapsulate the EL device in the transparent polymer materials for isolating the device from moisture and increasing the mechanical strength of the device. Further, the color of the light depends on the phosphors used. At present, only four colors are available, i.e. yellow, green, blue and white. A conventional way to change the color is to use various transparent color films as filters to achieve certain design requirements. These layers or films may further reduce the luminescent intensity because of the internal reflection of light passing through these layers and the reflection at the interfaces thereof. Thus, the effective use of the emitting light and enhancement of the light intensity are primary concerns of this invention. In addition, eliminating moisture effect and reducing electrical shorting at the edges of the EL device are major concerns of this invention.

SUMMARY OF THE INVENTION

The primary object of the present invention is to provide an electroluminescent device which emits the lights from both sides of the device and has a symmetrically laminated structure. The double-sided EL device will have much broader commercial applications than the conventional EL device.

One objective of the present invention is to provide an EL device which has better moisture isolation and higher light intensity.

Another objective of this invention is to provide a double-sided EL device with its central phosphor layer having a desired pattern of display.

According to the present invention, a double-sided electroluminescent device emits light from both sides thereof and has a laminated structure in symmetry with respect to a central plane which is in the middle of the phosphor layer. The EL device comprises a pair of transparent substrates, a pair of transparent electrode layers formed respectively on the substrates, a pair of transparent insulating layers formed respectively on the electrode layers, each of the insulating layers having a step near an edge of the respective electrode layer, a pair of conductive bus bars formed respectively on the electrode layers against the steps of the insulating layers, a central phosphor layer mixed with a binder material disposed between both of the insulating layers and the bus bars and positioned on the central plane, and a transparent insulating frame surrounding and sealing peripheral edges of the central phosphor layer, the bus bars and the insulating layers, and separating the two electrode layers at their edge areas. Every a pair of parts mentioned above is in symmetry with respect to the central plane.

In the present invention, the two insulating layers and the transparent insulating frame are comprised of the same material and form a sealing box and encapsulate the phosphor layer therein. This sealing box can substantially eliminate the deleterious effect of moisture diffusion along the edges of the light emitting area of the device. The sealing configuration also serves as insulator to eliminate electrical shorting between the two electrodes or any failure at the edges of the device.

The binder of the phosphor layer and insulating layers are made of same oil base polymer material. Therefore, little if any reflection occurs at the interface between the phosphor and insulating layers. Moreover, there is no light scattering occurred in the insulating layers because there is no power dispersed in the transparent insulting layers. Thus, the present invention may substantially enhance the light intensity of the EL device.

Other features of the present invention can be understood in the description of the preferred embodiment as illustrated in the accompanying drawings.

DETAILED DESCRIPTION OF THE INVENTION

Figure 1:
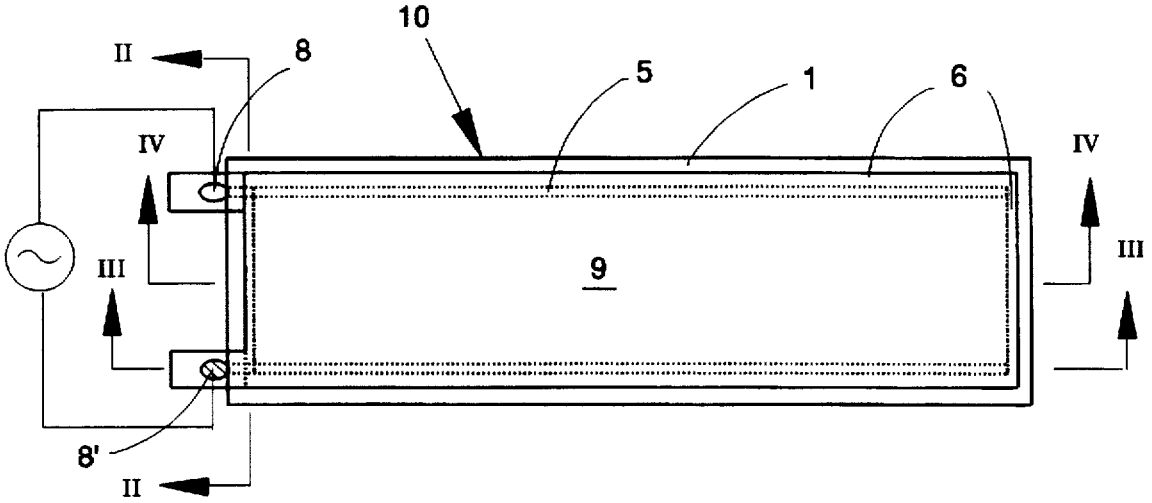
FIG. 1 is a plane view of the preferred embodiment of the EL device according to the present invention.
Figure 2:
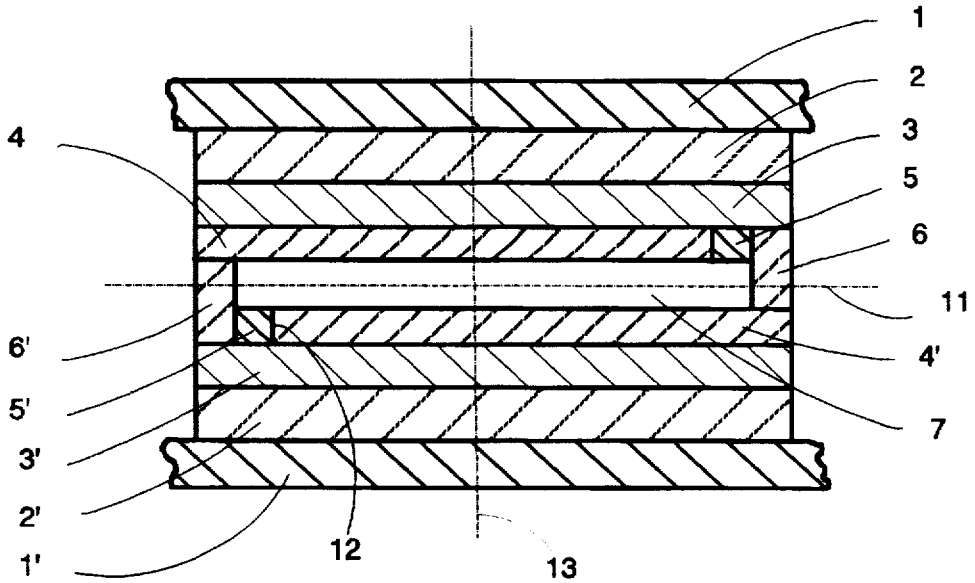
FIG. 2 is a cross-sectional view of the device taken along line II—II in FIG. 1 with omission of the side protective shell layers.

FIG. 1 shows a top plane view of the EL device 10 of this invention. The EL device 10 is generally rectangular. However, it can be any desired shape. The light emitting window 9 is usually centrally located. The electrical power is applied to two connectors 8 and 8' which are outwardly extended portions of the bus bars 5 and 5'. The bus bars 5 and 5' are respectively in contact with the transparent electrodes 3 and 3'as shown in FIG. 2. The out most layer of the laminated thin film device 10 is a transparent reinforcement shell 1 which seals the device and separates it from the environment.

FIG. 2 shows a cross-sectional view of FIG. 1 taken along line II—II. The device 10 has a laminated structure of multiple layers which are in symmetry with respect to a central symmetrical plane 11 in the central phosphor layer 7 and a symmetrical central point at the cross of the plan 11 and a vertical axis 13 of device.

The symmetrically laminated structure comprises a pair of transparent substrates 2 and 2', a pair of transparent electrodes 3 and 3', a pair of conductive bus bars 5 and 5', a pair of transparent insulating layers 4 and 4', a central phosphor layer 7, and a transparent insulating sealing frame 6. The transparent insulating sealing frame 6 is in symmetry with respect to the central point.

The transparent electrode layers 3 and 3' are precoated and respectively formed on the transparent substrates 2 and 2'. Then, the transparent insulating layers 4 and 4' are formed respectively on the transparent electrode layers 3 and 3'. Each of the insulating layer 4 or 4' does not completely cover the electrode layer 3 or 3', and leaves a step portion 12 near an edge of the electrode layer. There is a space between the step 12 and the corresponding edge of the electrode layer for formation of a bus bar 5 or 5' and a transparent insulating frame 6. Thus, the two bus bars 5 and 5' are oppositely positioned in symmetry with respect to the central symmetrical plane 11 and a vertical axis 13 of the device.

The phosphor layer 7 is positioned on the symmetrical plane 11 of the device. The phosphor layer 7 is disposed -between both insulating layers 4 and 4' and the bus bars 5 and 5'. The transparent insulating frame 6 is formed to surround the peripheral edges of the phosphor layer 7, the bus bars 5 and 5' and the insulating layers 4 and 4'. The insulating layers 4 and 4' and the transparent insulating frame strip 6 form a sealing box to further increase the isolation of the device from the moisture diffusion.

The substrates 2 and 2' can be any kind of optical transparent polymer films, such as polyester, polyimide and polychlorotrifluoroethylene. The thickness of the substrate can go from several ten micrometers to several hundred micrometers, depending on any specific design.

The transparent conductive electrode layers 3 and 3' are formed on the substrates 2 and 2' by a sputtering process. The electrode layers can be made of materials, such as indium tin oxide (ITO), stainless steel (SS), titanium copper stainless steel (TCSS) composite, or zirconium. The thickness of the transparent conductive layer is from several hundred angstroms to several thousand angstroms, depending on the materials used.

The bus bars 5 and 5' are made of conductive material and can be transparent or opaque. They will not block much emitted light since they are very thin and occupy a little space at the two opposite edge areas of the device. The conductive bus bars 5 and 5' are coated or screen printed on the transparent conductive layers 3 and 3' inside the latter's edge areas. The silver type conductive ink is preferred for this application. Hence, the thickness of the bus bar can be well controlled. The thickness of the bus bar is around 5–10 μm. Some conductive coatings, i.e. carbon, silver or copper, nickel conductive coatings or polyester/ ITO paste are suitable for producing the bus bar.

Figure 3:
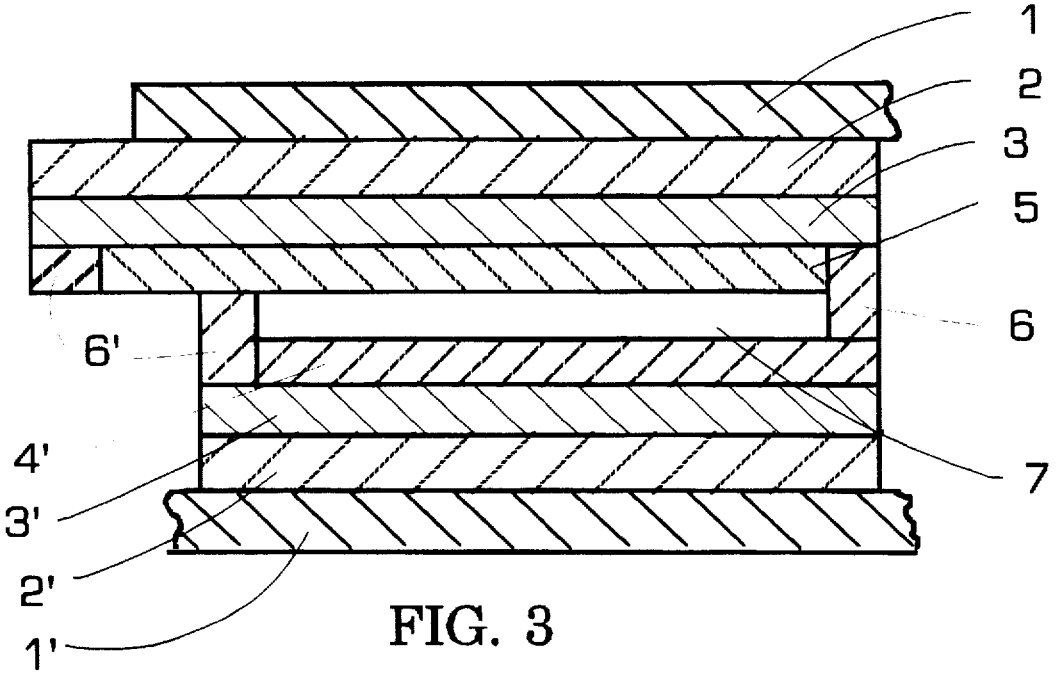
FIG. 3 is a cross-sectional view of the device taken along line III—III in FIG. 1.

Referring to FIG. 3, one end of each bus bar extends out of the light emitting window area 9 and the edge of the device 10. The extended parts of the bus bars are used as electrical connectors 8 and 8'. A portion of the electrode layer 3 or 3', on which the bus bar is formed, extends out of the peripheral edge of the device 10. Similarly, a portion of the corresponding substrate 2 also extends out of the edge of the device 10 to constitute a support for the outwardly extended bus bar and the electrode layer, thereby to form the electrical connector 8 or 8'.

The transparent insulating layers 4 and 4' are respectively formed on the transparent conductive electrode layers 3 and 3'. The transparent insulating frame 6 is formed around the peripheral edge of the device 10 within the side shell 1. It surrounds and seals primarily the edge of the central phosphor layer 7. The insulating layers 4 and 4' have the same thickness as that of the bus bars, approximately 5–10 μm. The thickness of the insulating frame is around 25 μm. The insulating frame can be transparent.

Figure 4:
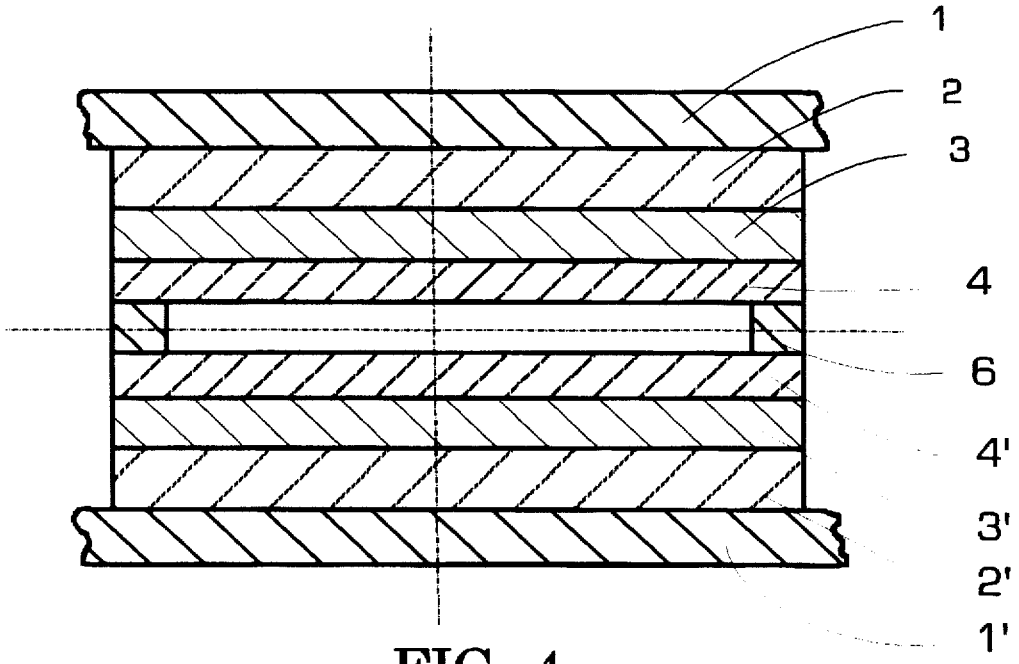
FIG. 4 is a cross-sectional view of the device taken along line IV—IV in FIG. 1.

FIG. 4 shows the completely sealed edges of the phosphor layer 7 by the transparent insulating frame 6. It clearly shows the sealing box formed by the two insulating layers and the insulating frame.

The phosphor layer 7 is first formed on one of the transparent insulating layer 4 and bus bar 5 by screen printing process or any other wet-coating techniques. The phosphor layer 7 is formed by the phosphor particles dispersed into an oil-base polymer solution and printed into a layer of approximately 10–30 μm thick. The polymer binds the phosphor particles to form the central phosphor layer 7. The polymer binder keeps the phosphor particles separate from each other. The same polymer is used to make the transparent insulating layers 4 and 4' and the transparent insulating frame 6. The use of the same material makes very good interfaces between the phosphor layer and the insulating layer. The reflection at the interface between the phosphor layer and the insulating layer is completely eliminated.

The phosphor layer can be made to have different shapes or patterns. Thus, only the predetermined portions of the phosphor layer emit light in conformity with the desired display. The display are identical at both sides of the device.

Then, under a vacuum condition, the transparent insulating layer 4 and bus bar 5 already put together with phosphor layer 7 will adhere with the other transparent insulating layer 4' and bus bar 5' by an appropriate pressure to finally form the EL device 10. Thereafter, under the vacuum condition and by light pressure, a one-sided adhesive transparent tape or any applicable plastic layer is applied to encapsulate the device, and forms the reinforcement shell 1. The transparent tape or plastic layer encapsulates the device completely. The refractive index of the adhesive transparent tape should be higher than that of the substrate. The higher refractive index of the protective shell may substantially improve the internal refraction, while reduce the internal reflection of the shell so as to enhance the intensity of the emitting light.

In the present double-sided EL device, a high electric field of several MV/m may be induced to the phosphor layer 7 by electrically charging the two transparent electrode layers 3 and 3' through the bus bars and the connectors 8 and 8'. The electrical power is connected on the connectors 8 and 8' which in turn apply the power to the conductive bus bars 5 and 5'. Each of the bus bars is in contact with a transparent electrode layer along an edge thereof. The two bus bars 5 and 5' are oppositely positioned so that the electric field is uniformly induced on the phosphor layer 7.

In the present double-sided EL device, the transparent insulating and sealing frame serves as an insulator surrounding the edge area to prevent the electrical shorting. It also serves as a seal to isolate the phosphor layer from environment. Therefore, the sealing provides better isolation of the device from the moisture.

The use of same material for the binder of the phosphor layer and the insulating layers completely eliminate the internal reflection at the layers' interfaces. There is no high, permittivity powder dispersed in either the binder or the insulating layers. Thus, the light scattering problem has been minimized. Therefore, the luminescent intensity is enhanced.

I claim:

1. A double-sided electroluminescent device emitting light from both sides thereof and having a laminated structure in symmetry with respect to a central plane and a central point at a cross of the central plane and a vertical axis of device, said device comprising a pair of transparent substrates, a pair of transparent electrode layers formed respectively on the substrates, a pair of transparent insulating layers formed respectively on the electrode layers, each of the insulating layers having a step near an edge of the respective electrode layer, a pair of conductive bus bars formed respectively on the electrode layers against the steps of the insulating layers, a central phosphor layer mixed with a binder material disposed between both of the insulating layers and the bus bars and positioned on the central plane, and a transparent insulating frame surrounding and sealing peripheral edges of the central phosphor layer, the bus bars and the insulating layers, said transparent insulating frame separating the two electrode layers at their edge areas.

2. The device of claim 1, wherein said transparent insulating layers and said binder of the phosphor layers are made of the same oil-based polymer.

3. The device of claim 1, wherein said transparent sealing frame forms an insulator between the electrode layers at edge areas of the device.

4. The device of claim 1, wherein one end of each said bus bar extends out of the peripheral edge of the device to form an external electrical connector, through said connectors and the bus bars an electrical field being applied to excite the phosphor layer.

5. The device of claim 1, wherein said bus bars are disposed oppositely with respective to the symmetrical plane and a vertical axis of the device.

6. The device of claim 1, wherein said insulating layers and transparent insulating frame are comprised of the same material and form a sealing box to encapsulate the phosphor layer therein.

7. The device of claim 1, further comprising a transparent plastic layer as a protective shell encapsulating the device of laminated structure.

8. The device of claim 7, wherein said transparent plastic shell has a refractive index higher than that of said substrates.

9. The device of claim 1, wherein said transparent electrode layers are selectively made from indium tin oxide, stainless steel, titanium copper stainless steel composite, or zirconium.

10. The device of claim 1, wherein said insulating layers and the bus bars have the same thickness of 5 to 10 μm, said bus bars selectively made from carbon, silver, copper, or nickel.

11. The device of claim 1, wherein said binder is a polymer which binds phosphor particles therein to form said phosphor layer, the polymer keeping the phosphor particles separate one from another.

12. The device of claim 1, wherein said phosphor layer is 10 to 30 μm thick.

13. The device of claim 1,wherein the phosphor layer has a predetermined pattern of display.

14. A double-sided electroluminescent device emitting light from both sides thereof and having a laminated structure in symmetry with respect to a central plane, said device comprising a pair of transparent substrates, a pair of transparent electrode layers formed respectively on the substrates, a pair of transparent insulating layers formed respectively on the electrode layers, each of the insulating layers having a step near an edge of the respective electrode layer, a pair of conductive bus bars formed respectively on the electrode layers against the steps of the insulating layers, a central phosphor layer mixed with a binder material disposed between both of the insulating layers and the bus bars and positioned on the central plane, and a transparent insulating frame surrounding and sealing peripheral edges of the central phosphor layer, the bus bars and the insulating layers, said insulating frame separating the two electrode layers at their edge areas, wherein said transparent insulating layers and said binder of the phosphor layers are made of the same material.

15. The device of claim 14, wherein the material of said transparent insulating layers and said binder of the phosphor layers is an oil-based polymer.

16. The device of claim 14, wherein said insulating layers and transparent insulating frame are comprised of the same material and form a sealing box to encapsulate the phosphor layer therein.

17. The device of claim 14, wherein said transparent sealing frame forms an insulator between the electrode layers at edge areas of the device.

* * * * *